US005158099A

United States Patent [19]

Rosen et al.

[11] Patent Number: 5,158,099

[45] Date of Patent: Oct. 27, 1992

[54] WETTED IMPACT BARRIER FOR THE REDUCTION OF TAR AND NICOTINE IN CIGARETTE SMOKE

[76] Inventors: William E. Rosen; David I. Rosen; Adam H. Rosen, all of 2055 Wisteria La., LaFayette Hill, Pa. 19444

[21] Appl. No.: 432,168

[22] Filed: Nov. 6, 1989

[51] Int. Cl.[5] ..... A24B 3/18

[52] U.S. Cl. ..... 131/335; 131/331

[58] Field of Search ..... 131/335, 331

*Primary Examiner*—V. Millin

[57] ABSTRACT

A wet impact barrier filter medium for a smoking article wherein the wet impact barrier is coated across the end of the filter substantially transverse of the smoking article. In another embodiment, the filter may have an indentation with the wet impact barrier contained in the indentation. The wet impact barrier is applied in a sufficient amount so as to reduce tar and nicotine produced by the products of combustion.

2 Claims, 2 Drawing Sheets

FIG. 6
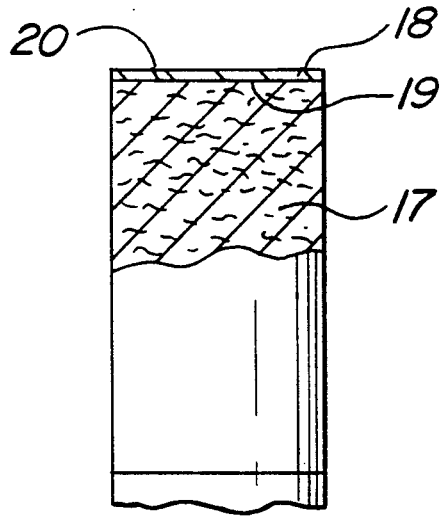
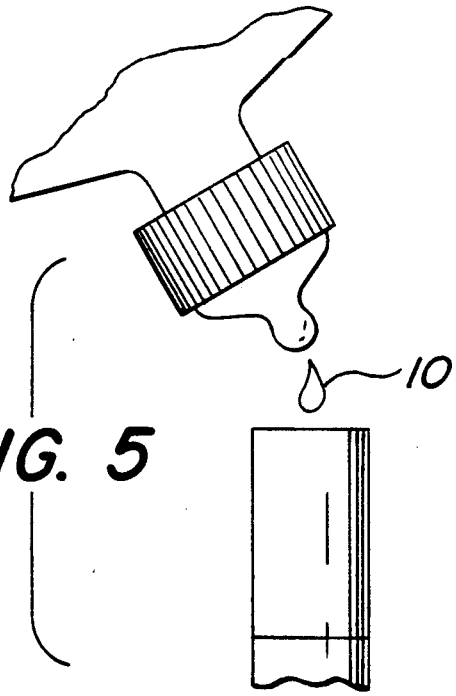
FIG. 5
FIG. 7
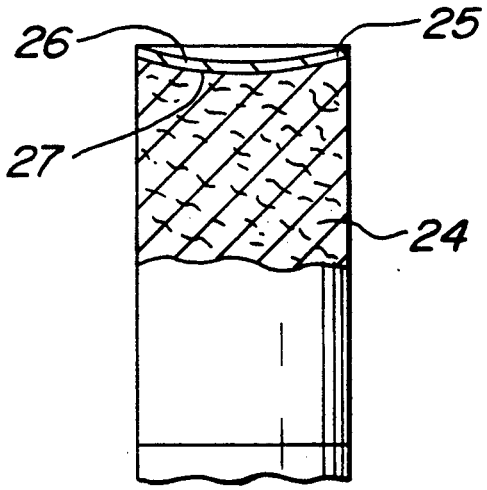
FIG. 8
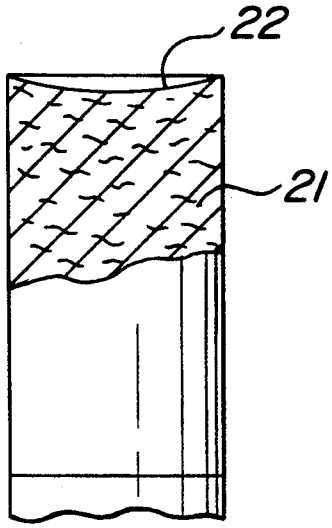
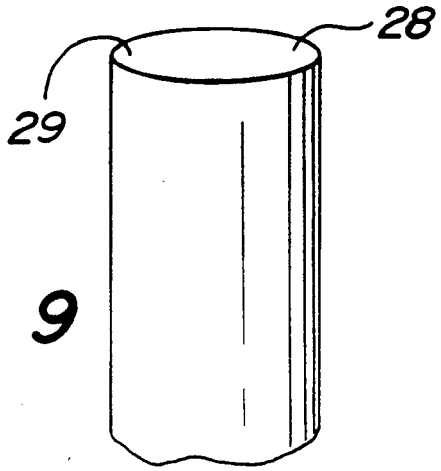
FIG. 9

WETTED IMPACT BARRIER FOR THE REDUCTION OF TAR AND NICOTINE IN CIGARETTE SMOKE

DESCRIPTION OF PRIOR ART

There have been attempts to design efficient elements for tobacco smoke have been described in the prior art and several of these elements contain means for moistening or humidifying a porous filter. Typically, a module containing water or an aqueous solution is embedded in the filter and the module is compress to release the liquid before the filter is used. The moistened filter material in the element then exhibits an improved ability to remove the primary tars, nicotine, and certain other volatiles from the smoke.

For example, in U.S. Pat. No. 3,884,246, Eric E. Walker, a tobacco smoke filter element comprising of a resilient, water impervious elongated tubular casing having a porous plug of filtering material disposed in each end of said casing; opposed, mutually spaced, disc-like walls disposed within said casing between said plugs one wall within said casing between sand plugs one wall abutting the inner surfaced of each plug, said walls defining a chamber within the central portion of said casing and having at least one port in each wall; at least one liquid containing module disposed within said chamber and extending between said walls, said walls at least one passage for smoke through said filter element; means carried by said element and cooperating between said module and at least one port in each of said walls for directing liquid from said module through the ports into said plugs responsive to compression of the external walls of said chamber so that said plugs may act selectively as a dry filter or, when said casing is compressed, as a filter moistened by said liquid.

In U.S. Pat. No. 3,428,049 to Leake et al one or more of such modules are surrounded by a compressed filter material in the element. When the module is compressed the liquid saturates the filter material causing it to expand and occupied by the module. It is made as part of the cigarette, confined to the filter.

In U.S. Pat. No. 3,635,226 to Horsewell et al. a liquid-containing capsule is disposed between an absorbent plug, adjacent the tobacco, and a nonabsorbent plug. when the capsule is compressed the liquid is released into the absorbent plug. U.S. Pat. No. 3,596,665 to Lundegard also describes a frangible, liquid containing module disposed between two plugs. Compression of this module releases the liquid into both plugs for enhanced filtering.

In addition, many different liquids have been used encapsulated within the filter mechanism to moisten the filters. Examples thereof are water, glycerin, and aqueous solutions or emulsions containing aromatic flavoring agents. These liquids act, in the filter, primarily to cool the smoke and to facilitate condensation of volatile components therein on the filter substrate.

The above mentioned filters describe smoke filters containing collapsible or frangible capsules filled with water or other liquids. Filter elements containing liquid pose a problem of retaining the liquid during storage, and those containing capsules or other containers of a liquid often present within the filter structure release of the liquid a problem of holding the released liquid in place without permitting the filter element to remain collapsed after pressure on filter has been released.

The aforementioned prior filters lack the desired versatility necessary for widespread acceptance.

In the above mentioned products. the liquid products were encapsulated inside the filter or made as an attachment to the filter. The module is manufacturing as part of the filter elements.

AquaFilter, U.S. Pat. Nos. 4,003,387, 4,046,153 and 3,797,644, is a disposable cigarette holder made of plastic, which has a wet cotton filter on the inside. The wetness is glycerin and water. The holder is attached to the cigarette which draws smoke into and over the wet cotton filter, held together by plastic casing, into the mouth, which caused the smoke to condensate tar and nicotine (total particular matter) on to the fiber wet filter. In this product, it is an attachment. Most smokers object to having a foreign object, such as plastic in their mouth.

As a practical matter, the process of manufacturing and packaging cigarettes and the necessity for storing cigarettes for varying periods of time, have proven to be affected because of damage to filter, drying out, impact or disfiguring of the filter with moisture before smoked.

Another example, in U.S. Pat. No. 3,319,632, Cigarette Moistener by Henry Burbig, this invention relates to a cigarette moistener device. A device for moistening the interior of the filter tip of a cigarette. The device is topped by a receptacle and is provided with a hollow needle extending axially thereof and with a number of openings in the side of the hollow needle; the hollow needle extends into the moistener container. Where the moistener container is a squeeze bottle with resilient side, the insertion of the filter into the receptacle and squeezing the sides of the moistener container will result in impregnating the inner part of the filter with moisture; the utilization of a hollow needle of greatly restricted diameter will meter the amount of moisture thus expressed on a single squeeze, to impregnate the interior of the cigarette filter with water.

Following the making of my invention; I considered the following prior U.S. Pat. Nos.:

3,884,246 E. E. Walker, Optional Dry or Liquid Filter
3,428,049 P. H. Leake & E. C. Cogbill, Tobacco Smoke Filter
3,635,226 Horsewell et al.
3,595,665 to Lundegard et al.
4,003,387 & 4,046,153 & 3,797,644 Aquafilter
3,319,632 H. Burbig, Cigarette Moistener but I found that none of this prior art has suggested the structure or operation of my invention.

SUMMARY OF INVENTION

Our invention is a wetted impact barrier. It is not part of a filter until the pinkish/red food coloring solution is dispensed only on the top surface of the filter mouthpiece, which is wetted by the person physically applying the wetted impact barrier to the top surface of filter moutpiece. The top surface of the filter mouthpiece is the only part of the filter that is wetted. It can be dispensed on every cigarette filter type. The solution of this invention becomes a wetted impact barrier only when dispensed upon desire of the user on the top surface of mouthpiece of any filter type cigarettes and then smoked. The wetted impact barrier is always fresh and acqueas and also bacteria free, no dry out characteristics, and this is because it is a separate, free standing component. It is the object to provide the person with a visual way of applying this wetted impact barrier because the solution is added with food coloring which also shows how much is desired for wetted impact barrier. It is still another object to provide the user with a visual condensation of (total particular matter) tar and nicotine on the visual end of the filter mouthpiece when smoked. It is yet another object to have the pinkish/red color so the smoker can see the pink turn into a dark brown or black (tars) to give them a sense that the wetted impact barrier is working effectively.

A group of Marlboro cigarettes were treated with the wetted impact barrier by applying the wetted impact barrier onto the top surface of mouthpiece onto the filter material before being smoked. The cigarettes were then smoked on a cigarette smoking machine according to the method approved and utilized by the F.T.C. Another group of Marlboro Cigarettes were smoked on the cigarette smoking machine, as is (without the wetted impact barrier). Upon accumulation and measurement of the condensate the results were as follows:

| | Without Pinkish/ Red Liquid | With Pinkish/ Red liquid |
|---|---|---|
| Nicotine | 1.13 | 0.13 |
| Tars | 17.1 | 1.75 |

A group of Winston Cigarettes were also treated with the wetted impact barrier by applying the wetted impact barrier onto the top surface of mouthpiece on conventional cigarette filter type before being smoked. The Winston Cigarettes were then smoked on a cigarette smoking machine according to the method approved and utilized by the F.T.C. A group of Winston Cigarettes were also smoked on the machine without the wetted impact barrier being applied. Upon accumulation and measurement of the condensate the results were as follows:

| | Without Pinkish/ Red Liquid | With Pinkish/ Red Liquid |
|---|---|---|
| Nicotine | 1.43 | 0.03 |
| Tars | 19.7 | 0.22 |

As you smoke the cigarette, you will see the pinkish/red discolor as the wetted impact barrier cools smoke and condensates large amounts of tar and nicotine that you would other wise be inhaling. The reason for the pinkish/red color of the wetted impact barrier is so the user can see just how much of the wetted impact barrier is being applied and allows for equal distribution of the wetted impact barrier on the top surface of mouthpiece.

Not only is the present invention more effective than any of the devices and methods of the known prior art, but it is also inexpensive and easy to use.

While the invention has been described with respect to particular embodiments, the invention should not be deemed limited by these examples. The wetted impact barrier can be provided in many forms. Many substances can be substituted for the wetted impact barrier, as stated. It is understood that the invention can thus be modified in many ways, and that such modifications are within the spirit and scope of the following claims:

DETAILED DESCRIPTION OF THE DRAWINGS

Figure 1:
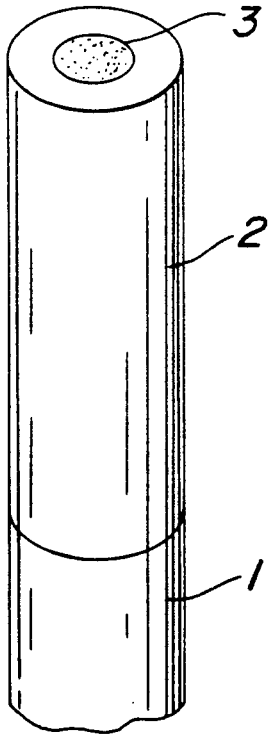
FIG. 1 illustrates a smoking article with a filter having the wet impact barrier applied to the end of the filter.
Figure 2:
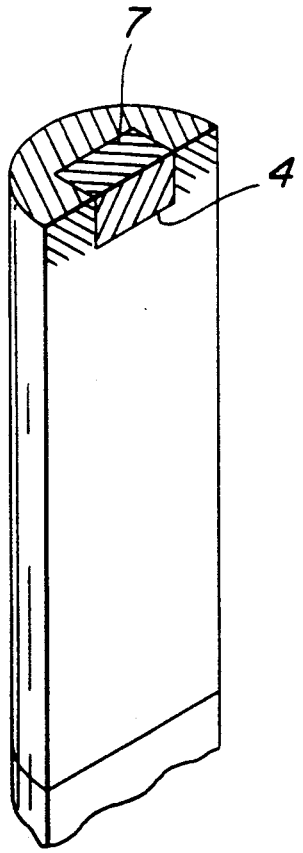
FIGS. 2–4 illustrate a smoking article having an indentation or wellular recess with the wet impact barrier contained therein.
Figure 3:
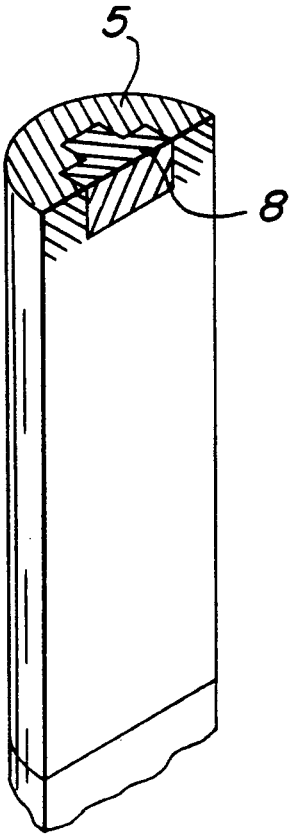
Figure 4:
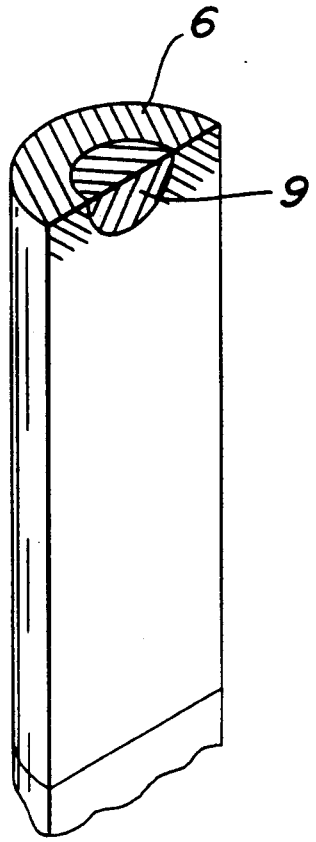

FIG. 1 illustrates a smoking article 1 having a filter section 2 with a wet impact barrier 3 coated across the end of said mouthend substantially transverse of the smoking article. FIGS. 2–4 illustrate wellulor recesses or indentations 4–6 which contain the wet impact barrier 7–9 respectively contained therein.

We claim:

1. A smoking article comprising an end to be lit and a mouthend, said mouthend comprising a fibrous medium and having a wet impact barrier coated across the end of said mouthend substantially transverse of said smoking article said wet impact barrier being of sufficient amount to reduce tar and nicotine produced from the combustion of said smoking article when said products of combustion contact said wet impact barrier.

2. A smoking article comprising an end to be lit and a mouthend, said mouthend comprising a fibrous medium, the end of said mouthend having an indentation formed therein and extending into the mouthend portion of said article, said indentation containing a wet impact barrier contained therein said wet impact barrier being of sufficient amount to reduce tar and nicotine produced from the combustion of said smoking article when said products of combustion contact said wet impact barrier.

* * * * *